US006098909A

United States Patent [19]

Meyer et al.

[11] Patent Number: 6,098,909

[45] Date of Patent: Aug. 8, 2000

[54] LAYING TUBE FOR WINDINGS

[75] Inventors: Meinert Meyer; Klaus Küppers, both of Erkrath, Germany

[73] Assignee: SMS Schloemann-Siemag Aktiengesellschaft, Düsseldorf, Germany

[21] Appl. No.: 09/315,684

[22] Filed: May 20, 1999

[30] Foreign Application Priority Data

May 23, 1998 [DE] Germany ..... 198 23 198

[51] Int. Cl.[7] ..... B21C 47/10

[52] U.S. Cl. ..... 242/361; 242/361.2

[58] Field of Search ..... 242/360, 361, 242/361.2, 361.4, 361.5, 361.1, 363

[56] References Cited

U.S. PATENT DOCUMENTS

| | | | |
|---|---|---|---|
| 426,067 | 4/1890 | Roberts | 242/361 |
| 444,652 | 1/1891 | Roberts | 242/361 |
| 3,469,798 | 9/1969 | Schroder | 242/361.2 X |
| 3,750,974 | 8/1973 | Dibrell | 242/360 X |
| 3,780,963 | 12/1973 | Hirschfelder | 242/361.2 |
| 4,353,513 | 10/1982 | Holthoff | 242/361 |
| 4,765,556 | 8/1988 | Nasrah | 242/361 |
| 5,819,614 | 10/1998 | Jander | 242/361.2 X |
| 5,934,594 | 8/1999 | David | 242/361 |

FOREIGN PATENT DOCUMENTS

| | | | |
|---|---|---|---|
| 0 779 115 | 6/1997 | European Pat. Off. . | |
| 1071026 | 12/1959 | Germany | 242/361.4 |

*Primary Examiner*—Donald P. Walsh
*Assistant Examiner*—William A. Rivera
*Attorney, Agent, or Firm*—Friedrich Kueffner

[57] ABSTRACT

A laying tube for producing wire windings from continuously introduced essentially straight wire material includes a first portion of an outer casing which is driven so as to rotate and receives a feeding tube for the wire material. Connected to the first portion is an outwardly expanding portion of the outer casing which includes a curved wire guide channel, wherein this guide channel is provided in the form of a groove in the outer surface of a hollow insert which is placed with fit in the expanding portion of the outer casing, and wherein the centrifugal forces of the wire are absorbed by the inner surface of the outer casing. The feeding tube and the insert form a structural unit which is releasably connected to the outer casing. This structural unit and, thus, the impact surfaces of the centrifugal forces of the wire can be moved in dependence on the localized wear of the inner surface of the outwardly expanding portion of the outer casing and relative thereto by a rotary movement about the longitudinal axis to an area which has not yet been worn out.

7 Claims, 1 Drawing Sheet

LAYING TUBE FOR WINDINGS

BACKGROUND OF THE INVENTION

1. Field of the Invention

The present invention relates to a laying tube for producing wire windings from continuously introduced essentially straight wire material.

2. Description of the Related Art

As is well known in the art, the wear to which laying tubes for windings in wire trains are subjected is substantial.

Depending on the rolled dimensions and wire quality, the service life of laying tubes for windings is about two to five thousand metric tons. In the most unfavorable case, this means a service life of only three eight hour shifts when the production is 80 t/h in each line.

For replacing a worn out laying tube, the complete winding layer must be disassembled; this is very time-consuming and labor-intensive.

Accordingly, it has been repeatedly attempted to find solutions for increasing the service life of laying tubes for windings. For this purpose, European Patent Application EP 0 779 115 A1 proposes a laying tube which is composed of a first element which is driven so as to rotate and a second element which opens out in the shape of a bell. In this second element, a curved guide channel is provided. The wire material is conducted into this guide channel by means of a feeding tube which is mounted in the first element of the laying tube.

In an embodiment of this European Patent Application, the guide channel is formed by a groove which is provided in the outer surface of a hollow insert, wherein this insert is placed with fit in the opening portion of the laying tube. Consequently, the inner surface of the outer casing forms a portion of the wire guide channel.

The European Patent Application mentioned above further proposes to provide next to a first guide channel a second guide channel which is arranged symmetrically relative to the first guide channel. On the one hand, the second channel compensates the imbalance which is due to the centrifugal forces and, on the other hand, the second channel can be used as an alternative to the first guide channel when the first guide channel is worn out. In case of wear of the first channel, the wire is conducted into this alternative channel by rotating the feeding tube and placing it against the channel opening.

FIG. 4 of the European Patent Application referred to above shows an embodiment with four such guide channels which, consequently, means that the service life has been increased fourfold.

SUMMARY OF THE INVENTION

Therefore, starting from the prior art discussed above, it is the primary object of the present invention to provide a laying tube for windings whose service life can be increased several times without disassembling the entire winding layer.

In accordance with the present invention, the laying tube in a winding layer includes a first portion of an outer casing which is driven so as to rotate and receives a feeding tube for the wire material. Connected to the first portion is an outwardly expanding portion of the outer casing which includes a curved wire guide channel, wherein this guide channel is provided in the form of a groove in the outer surface of a hollow insert which is placed with fit in the expanding portion of the outer casing, and wherein the centrifugal forces of the wire are absorbed by the inner surface of the outer casing. The feeding tube and the insert form a structural unit which is releasably connected to the outer casing. This structural unit and, thus, the impact surfaces of the centrifugal forces of the wire can be moved in dependence on the localized wear of the inner surface of the outwardly expanding portion of the outer casing and relative thereto by a rotary movement about the longitudinal axis to an area which has not yet been worn out.

The present invention is based on the finding that the wear of a laying tube as a result of the frictional forces of the wire material travelling therethrough takes place primarily in the last portion of the laying tube because this is where the centrifugal forces of the wire are the greatest.

However, because of the curved guide channel or groove only a localized wear of the inner surface of the outwardly expanding portion of the outer casing takes place.

According to the present invention, in a conventional laying tube arrangement as it is described in European Patent Application EP 0 779 115 A1, it is proposed to combine, for example, through a welded connection, the feeding tube and the insert to form a structural unit.

In case of wear, this structural unit is moved by a rotary movement relative to the outer casing until the principal impact surface of the wire guide channel covers an area of the outer casing which has not yet been worn. Preferably, this is achieved by rotating the structural unit by 2 to 3°. Subsequently, the structural unit is once again fixedly connected to the outer casing.

This procedure can be repeated as many times as it takes until the structural unit, particularly the insert, has been rotated by an angle of 360°. This corresponds to approximately 180 adjustments. Only then is the outer casing replaced or ground.

This means that the present invention makes it possible to achieve not only a fourfold increase of the service life, but a much greater increase; in the best case, the increase is 180 times greater. Contrary to the laying tube according to the European Patent Application referred to above, it is not necessary to provide new guide channels each time. In accordance with the invention, the complete inner surface of the outer casing is utilized by a rotary movement of the insert which can be easily carried out.

After the rotation of the structural unit has been carried out, the structural unit is once again locked to the outer casing. Preferably, a tightening nut which acts on the narrow inlet area of the outer casing is provided for this purpose.

In accordance with an advantageous embodiment, the outer casing of the laying tube is composed of two elements which are releasably connected to each other, i.e., a first portion which is driven so as to rotate and a second outwardly expanding portion. In this embodiment, it is not necessary to replace the entire outer casing; rather, only the worn second portion has to be replaced.

In addition, in order to increase the service life it is proposed to manufacture the inner surface of the outer casing coming into contact with the wire of a wear-resistant material or to coat the inner surface with this material. The same applies analogously to the inner surface of the guide channel in the insert portion. This material may be, for example, a wear-resistant ceramic material.

In accordance with a preferred embodiment of the invention, the outer casing is funnel-shaped. In that case, the insert which is received by the expanding portion of the outer casing is conically shaped.

The outer casing as well as the insert may preferably be manufactured of light metals or composite materials.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
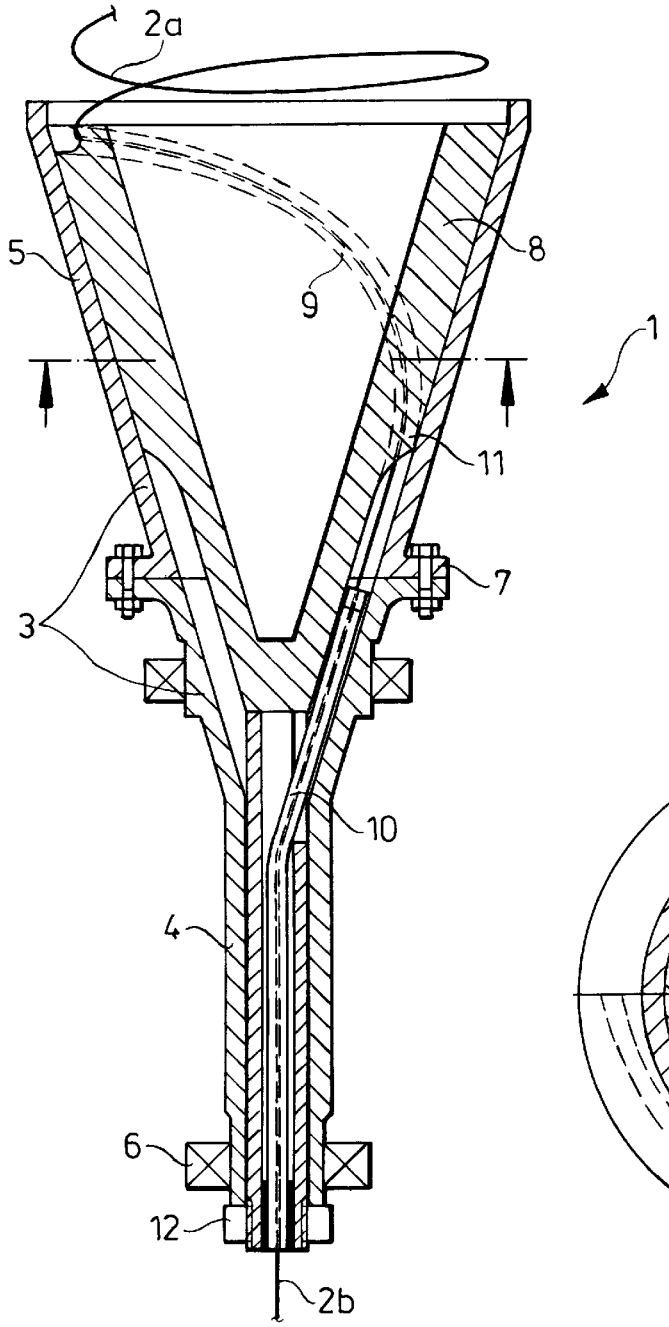
FIG. 1 is a longitudinal sectional view of an embodiment of a laying tube for windings according to the present invention.

FIG. 1 of the drawing shows a laying tube 1 for producing windings of wire material 2*a* from an essentially straight wire material 2*b*.

The laying tube 1 for windings is composed of a funnel-shaped outer casing 3 which includes a narrow portion 4 and an outwardly expanding portion 5. The narrow portion 4 is supported by bearings 6 and is driven so as to rotate. The two portions 4 and 5 of the outer casing 3 are releasably connected to each other through flanges 7.

The outwardly expanding portion of the funnel 5 receives an insert 8 with fit; in the illustrated embodiment, the insert 8 is an internal conical element. A guide groove 9 is provided, preferably by milling cutting, in the outer surface of the internal conical element 8. The guide groove 9 extends spirally along the outer surface of the internal conical element 8. In cooperation with the inner surface of the outer casing, this results in a guide channel for the wire material. In other words, the inner surface of the outer casing 5 forms the cover for the guide groove 9 cut into the internal conical element 8.

The internal conical element 8 and, thus, the guide groove 9 provided in the internal conical element 8, are rigidly connected to a feeding tube 10 which guides the wire 2*b* entering through the narrow portion of the outer casing 4 toward the guide groove 9.

Consequently, the internal conical element 8 and the feeding tube 10 form a structural unit. This complete structural unit is placed in the outer casing 3 and locked by a tightening nut 12.

Figure 2:
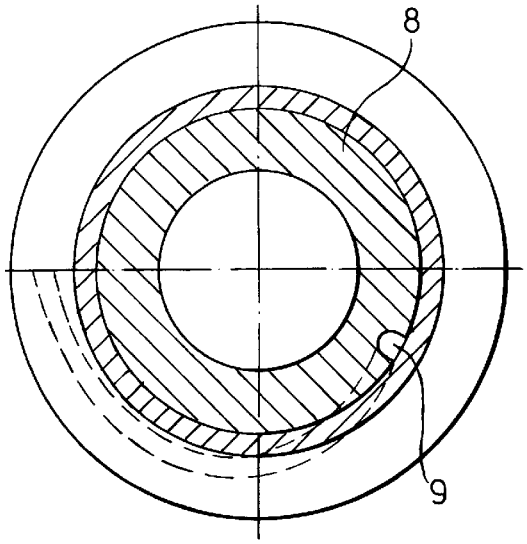
FIG. 2 is a transverse sectional view of the embodiment of FIG. 1.

The sectional top view of FIG. 2 shows the internal conical element 8, wherein the guide groove 9 is shown in broken lines.

It has been found that, when manufacturing wire windings in laying tubes, the greatest wear occurs at the expanding portion of the outer casing, primarily at the edge area thereof. The present invention makes use of this finding. After wear has occured, the tightening nut 12 is loosened and the structural unit 11 composed of internal conical element and feeding tube is rotated by an angle of about two to three degrees. This means that the guide groove 9 is now once again covered by an area of the funnel-shaped portion 5 of the outer casing 3 which has not yet been worn. It is conceivable to adjust the structural unit 11 also during the operation of the laying tube, so that a guide groove which has not yet been worn can be made available without loss of time.

This procedure can be repeated until a full rotation has been reached. The funnel-shaped portion of the outer casing 5 is then removed and replaced.

While specific embodiments of the invention have been shown and described in detail to illustrate the inventive principles, it will be understood that the invention may be embodied otherwise without departing from such principles.

We claim:

1. A laying tube for producing wire windings in a winding layer from continuously introduced essentially straight wire material, the laying tube comprising an outer casing having a first portion configured to be drivable for rotation and an outwardly expanding portion adjacent the first portion, wherein a feeding tube for the wire material is mounted in the first portion and the outwardly expanding portion has a helical wire guide channel, further comprising a hollow insert mounted in the outwardly expanding portion of the outer casing, wherein the wire guide channel is formed by a groove in an outer surface of the hollow insert, wherein an inner surface of the outer casing is configured to absorb centrifugal forces of the wire, wherein the feeding tube and the insert form a structural unit releasably connected to the outer casing, further comprising means for rotating the structural unit about a longitudinal axis of the laying tube in dependence on a localized wear of the inner surface of the outwardly expanding portion of the outer casing relative thereto toward an area of the inner surface which is not worn.

2. The laying tube according to claim 1, wherein the means of rotating the structural unit is configured to rotate the structural units by an angle of about 2 to 3°.

3. The laying tube according to claim 1, comprising a tightening nut for locking the structural unit to the outer casing.

4. The laying tube according to claim 1, wherein the inner surface of the outer casing coming into contact with the wire material is of a wear-resistant material.

5. The laying tube according to claim 1, wherein the outer casing is comprised of two portions, wherein a first portion of the outer casing is configured to be driven for rotation and an outwardly expanding second portion is releasably connected to the first portion.

6. The laying tube according to claim 1, wherein the outer casing is funnel-shaped.

7. The laying tube according to claim 6, wherein the insert is conically shaped.

* * * * *